US006582586B1

(12) United States Patent
Akashi et al.

(10) Patent No.: US 6,582,586 B1
(45) Date of Patent: Jun. 24, 2003

(54) METHOD OF REMOVING SCALES AND PREVENTING SCALE FORMATION ON METAL MATERIALS AND APPARATUS THEREFOR

(75) Inventors: Tooru Akashi, Futtsu (JP); Yasumitsu Kondou, Futtsu (JP); Shuuichi Hamausu, Futtsu (JP); Masao Sakashita, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 09/530,712

(22) PCT Filed: Jan. 25, 2000

(86) PCT No.: PCT/JP00/00341

§ 371 (c)(1),
(2), (4) Date: Aug. 21, 2000

(87) PCT Pub. No.: WO00/44964

PCT Pub. Date: Aug. 3, 2000

(30) Foreign Application Priority Data

Jan. 26, 1999 (JP) ..... 11/16718
Jan. 26, 1999 (JP) ..... 11/16719
Sep. 14, 1999 (JP) ..... 11/259903

(51) Int. Cl.[7] ..... B01D 17/06

(52) U.S. Cl. ..... 205/714; 266/114; 148/574

(58) Field of Search ..... 266/113, 114; 148/567, 574; 205/709, 714

(56) References Cited

U.S. PATENT DOCUMENTS 4,415,415 A * 11/1983 Zaremski ..... 204/141.5
5,472,579 A * 12/1995 Mabuchi et al. ..... 204/145 R
5,490,908 A * 2/1996 Kim et al. ..... 148/567
6,257,034 B1 * 7/2001 Fukumori et al. ..... 72/39

FOREIGN PATENT DOCUMENTS

WO PCT/JP00/00341 1/2000
WO WO00/44964 8/2000

* cited by examiner

*Primary Examiner*—Scott Kastler
(74) *Attorney, Agent, or Firm*—Kenyon & Kenyon

(57) ABSTRACT

Suppression and removal of scales are efficiently carried out in a steel material hot rolling process and the time of pickling treatment as a successive step is greatly shortened. In a water cooling step of metallic material 11 at a temperature of 100° to 1,200° C., scales are removed by applying a direct current or an alternating current to metallic material 11 at 0.1 to $10^5$ A/m$^2$ of unit surface area from pinch rolls 2 to rolls 6 or apron guides 7 on the outlet side of a hot rolling mill 1 and/or by injecting cooling water at a pH value of −2 to 4 onto the metallic material 11 from cooling headers 4 and apron guides 7.

28 Claims, 6 Drawing Sheets

METHOD OF REMOVING SCALES AND PREVENTING SCALE FORMATION ON METAL MATERIALS AND APPARATUS THEREFOR

TECHNICAL FIELD

The present invention relates to a process and an apparatus for removing scales and preventing scale formation on hot rolled or heat-treated metallic materials or hot metallic materials, such as steel, iron alloys, copper, copper alloys, zinc, zinc alloys, aluminium, aluminium alloys on the like materials in such circumstances as to form oxide scales as in a hot rolling step and/or a cold rolling step or a heat-treating step following the continuous casting step, or a hot metallic material cooling step following these steps or in a pickling step as well, whereby suppression and removal of scales can be carried out efficiently at a low cost for a short time.

BACKGROUND ART

Prior Art

Metallic materials, particularly steel materials, react with atmospheric oxygen in a heating step and a rolling step or a hot steel material cooling step to form iron oxide called scales on the surfaces. The scales formed on the surfaces of steel materials are partly peeled off during the press working, etc. and pressed into products, sometimes thereby degrading the product quality, for example, flaw formation, etc. On the other hand, to prevent the quality degradation, a pickling step to wash off the scales with an aqueous hydrochloric acid solution, etc. has been additionally required.

Thus, processes for controlling oxidation on the steel material surfaces, thereby preventing scale formation have been so far proposed.

For example, a process for suppressing scale formation by applying an oxidation-suppressing agent to steel material surfaces to form a film is popular, but water, when contained in the oxidation-suppressing agent, boils at a temperature of 500° C. or higher on the steel material surfaces and a water vapor layer is formed on the steel material surfaces, causing a failure to form an oxidation-suppressing agent film on the steel material surfaces or a failure of even application of the oxidation-suppresing agent. That is, there is such a disadvantage or a failure of full control of scale formation.

To overcome such a disadvantage, for example, Japanese Patent Koaki (Laid-Open) No. 4-236714 publication proposes a process for preventing scale formation on the steel material surfaces by applying to or spraying onto hot steel materials a polymer solution comprising copolymers containing ethylene oxide and propylene oxide as monomer components, which can be separated into liquid polymers and water when the solution reaches a temperature of 100° C. or higher and can form an aqueous polymer solution at a temperature below 100° C. upon mixing with water, but the pickling treatment still needs a long time.

Problem to be solved by the Invention

The process for suppressing oxidation of steel materials disclosed in said Japanese Patent Kokai (Laid-Open) No. 4-236714 publication cannot remove such scales as formed before the application of the polymer solution. Even by applying the such a polymer solution thereto, scale formation is inevitable, though in a very small amount, ultimately requiring a pickling step to wash off such scales.

An object of the present invention is to overcome the problems of prior art and provide a process and an apparatus for removing scales and preventing scale formation on metallic materials in a hot rolling step and/or a heat treatment step, etc., which can conduct suppression and removal of scales efficiently and can largely shorten the treatment time in the successive pickling step.

DISCLOSURE OF THE INVENTION

Means for solving Problem

Gists of the present invention are as follows:

(1) A process for removing scales and preventing scale formation on a metallic material, characterized by contacting cooling water with a metallic material at a temperature of 100° to 1,200° C. in a water cooling step for the metallic material, while applying a direct current or an alternating current to the metallic material at a current density of 0.1 to $10^5$ A/m$^2$ of unit surface area through the cooling water.

(2) A process for removing scales and preventing scale formation on a metallic material, characterized by contacting cooling water at a pH of −2 to 4 with a metallic material at a temperature of 100° to 1,200° C. in a water cooling step for the metallic material.

(3) A process for removing scales and preventing scale formation on a metallic material, characterized by contacting cooling water at a pH of −2 to 4 with a metallic material at a temperature of 100° to 1,200° C. in a water cooling step for the metallic material, while applying a direct current or an alternating current to the metallic material at a current density of 0.1 to $10^5$ A/cm$^2$ of unit surface area through the cooling water.

(4) A process for removing scales and preventing scale formation on a metallic material according to the foregoing item (1) or (3), characterized by using the metallic material as one of a positive electrode or a negative electrode or providing the metallic material between a positive electrode and a negative electrode for the current application.

(5) A process for removing scales and preventing scale formation on a metallic material according to any one of the foregoing items (1), (3) and (4), characterized by providing at least two of pairs each consisting of a positive electrode and a negative electrode facing each other discretely in a water cooling tank filled with cooling water so that the positive electrodes and the negative electrodes can be alternately arranged in a parallel with one another at distances, passing the metallic material through between the positive electrodes and the negative electrodes in the pairs in the cooling water, thereby contacting the cooling water with the metallic material, and applying a direct current to the metallic material by passing the current between the positive electrodes and the negative electrodes in the pairs.

(6) A process for removing scales and preventing scale formation on a metallic material according to any one of the foregoing items (1) and (3) to (5), characterized in that the cooling water has an electric conductivity of 0.01 to 100 S/m.

(7) A process for removing scales and preventing scale formation on a metallic material according to any one of the foregoing items (1) to (6), characterized in that water deaerated to a dissolved oxygen gas concentration of not more than $4.46\times10^{-5}$ mol/m$^3$ (1 ppm) is used as the cooling water.

(8) A process for removing scales and preventing scale formation on a metallic material according to any one of the foregoing items (1) to (7), characterized in that high pressure water with the pressure of 0.2942 to 49.03 MPa is made to hit the metallic material during the water cooling.

(9) A process for removing scales and preventing scale formation on a metallic material according to any one of the foregoing items (1) to (8), characterized in that high pressure water with the pressure of 0.2942 to 49.03 MPa is made to hit the metallic material after the water cooling.

(10) A process for removing scales and preventing scale formation on a metallic material according to any one of the foregoing items (1) to (9), characterized in that water containing at least one of hydrogen, ammonia, nitrogen, carbon dioxide and inert gases at a total dissolved gas concentration of $4.46\times10^{-5}$ mol/m$^3$ to 2.23 mol/m$^3$ (1 to $5\times10^4$ ppm) is used as the cooling water.

(11) A process for removing scales and preventing scale formation on a metallic material according to any one of the foregoing items (2) to (10), characterized in that hydrochloric acid, sulfuric acid or nitric acid is added to the cooling water.

(12) A process for removing scales and preventing scale formation on a metallic material according to any one of the foregoing items (2) to (10), characterized in that an oxidizing agent is added to the cooling water, thereby adjusting the cooling water to an ORP (oxidation-reduction potential) value of 0.5 V in NHE (Normal Hydrogen Electrode) to 2.0 V in NHE, or a reducing agent is added to the cooling water, thereby adjusting the cooling water to an ORP value of 0.5 V in NHE to −1.5 V in NHE.

(13) A process for removing scales and preventing scale formation on a metallic material according to any one of the foregoing items (2) to (10), characterized in that cooling water adjusted to an ORP (oxidation-reduction potential) value of 0.5 V in NHE to 2.0 V in NHE by an oxidizing agent or cooling water adjusted to an ORP value of 0.5 V NHE to −1.5 V in NHE by a reducing agent are used alternately for the cooling.

(14) A process for removing scales and preventing scale formation on a metallic material according to any one of the foregoing items (2) to (10), characterized in that oxidation potential water is partly or wholly used for the cooling water.

(15) A process for removing scales and preventing scale formation on a metallic material according to any one of the foregoing items (1) to (14), characterized in that the cooling water is adjusted to a temperature of 50° to 100° C.

(16) A process for removing scales and preventing scale formation on a metallic material according to any one of the foregoing items (1) to (15), characterized in that the cooling water is contacted with the metallic material at a relative speed of the cooling water and the metallic material to each other of 0.1 to 300 m/s.

(17) A process for removing scales and preventing scale formation on a metallic material according to any one of the foregoing items (1) to (16), characterized in that the cooled metallic material is successively washed with a liquid and/or a gas and then coated with beef tallow, mineral oil or chemical synthesis oil, followed by coiling.

(18) A process for removing scales and preventing scale formation on a metallic material according to the foregoing item (17), characterized in that the beef tallow, mineral oil or chemical synthesis oil each contains 0.0001 to 1% by weight of boron.

(19) A process for removing scales and preventing scale formation on a metallic material, characterized by subjecting a metallic material heated to a temperature of 100° to 700° C. beforehand or a metallic material at a temperature of 100° to 700° C. from the beginning to a pickling treatment by a pickling solution at a pH value of −2 to 4.

(20) A process for removing scales and preventing scale formation on a metallic material, characterized by subjecting a metallic material heated to a temperature of 100° to 700° C. beforehand or a metallic material at a temperature of 100° to 700° C. from the beginning to a pickling treatment by a pickling solution at a pH value of −2 to 4, while applying a direct current or an alternating current thereto.

(21) A process for removing scales and preventing scale formation on a metallic material according to the foregoing item (20), characterized by providing at least two of pairs each consisting of a positive electrode and a negative electrode facing each other discretely in a pickling tank filled with a pickling solution so that the positive electrodes and the negative electrodes can be alternately arranged in a parallel with one another at distances, passing the metallic material through between the positive electrodes and the negative electrodes in the pairs in the pickling solution, thereby contacting the pickling solution with the metallic material, and applying a direct current to the metallic material by passing the current between the positive electrodes and the negative electrodes in the pairs.

(22) A process for removing scales and preventing scale formation on a metallic material, characterized by subjecting a metallic material to a pickling treatment by a pickling solution after the process according to any one of the foregoing items (1) to (16), followed by coiling.

(23) A process for removing scales and preventing scale formation on a metallic material according to any one of the foregoing items (19) to (22), characterized in that the pickling solution is adjusted to a temperature of 50° to 100° C.

(24) A process for removing scales and preventing scale formation on a metallic material according to any one of the foregoing items (19) to (23), characterized in that the pickling solution is contacted with the metallic material at a relative speed of the pickling solution and the metallic material to one another of 0.1 to 300 m/s.

(25) An apparatus for removing scales and preventing scale formation on a metallic material, characterized by comprising a cooling apparatus that is comprising cooling headers and/or cooling nozzles for supplying cooling water and side guides for preventing leakage of cooling water from side edges, provided on the hot rolled metallic material at the outlet side of a hot rolling mill, and a direct current application to the metallic material through the supplied cooling water that is comprising pinch rolls provided on the outlet side of the hot rolling mill and acting as negative electrodes and being in electric contact with the metallic material, and rolls or apron guides provided behind the pinch rolls and acting as positive electrodes and being in non-electric contact with the metallic material through insulators.

(26) An apparatus for removing scales and preventing scale formation on a metallic material, characterized by comprising a cooling apparatus that is comprising cooling headers and/or cooling nozzles for supplying cooling water and side guides for preventing leakage of cooling water from side edges, provided on the hot rolled metallic material at the outlet side of a hot rolling mill, and a direct current application to the metallic material through the supplied cooling water that is comprising pinch rolls provided on the outlet side of the hot rolling mill and acting as positive electrodes and being in electric contact with the metallic material, and rolls or apron guides provided behind the pinch rolls and acting as negative electrodes and being in non-electric contact with the metallic material through insulators.

(27) An apparatus for removing scales and preventing scale formation on a metallic material, characterized by comprising a cooling apparatus that is comprising cooling headers and/or cooling nozzles for supplying cooling water and side guides for preventing leakage of cooling water from side edges, provided on the hot rolled metallic material at the outlet side of a hot rolling mill, and a direct current application to the metallic material with at least two of pairs each consisting of a positive electrode and a negative electrode facing each other being provided discretely in a water cooling tank filled with cooling water so that the positive electrodes and the negative electrodes can be alternately arranged in a parallel with one another, the metallic material being passed through between the positive electrodes and the negative electrodes in the pairs in the cooling water, thereby contacting the cooling water with the metallic material, and a direct current being applied to the metallic material by passing the current between the positive electrodes and the negative electrodes in the pairs.

BEST MODES FOR CARRYING OUT THE INVENTION

Figure 1:
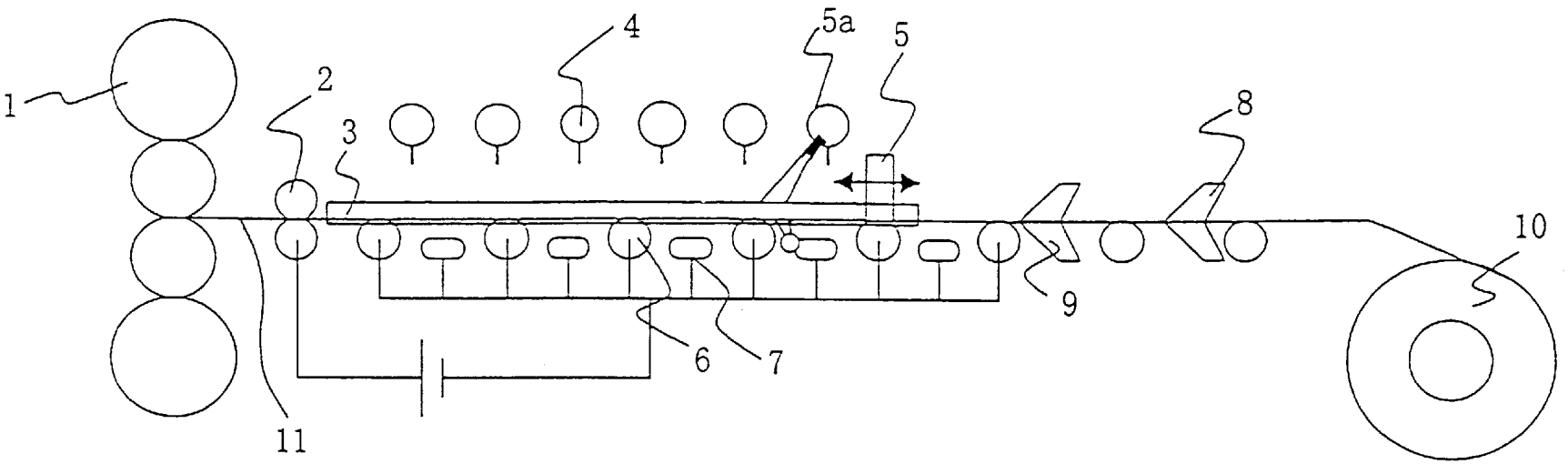
FIG. 1 is a view showing one embodiment of the apparatus according to the present invention.

The present inventors have made extensive studies on suppressiion and removal of scales formed on the surfaces of metallic materials such as hot and cold steel materials, etc., and will describe the principles of the present invention below, referring to drawings.

For example, oxides formed on a Fe surface at high temperatures are basically in a three-layer structure of wastite (FeO), magnetite ($Fe_3O_4$) and hematite ($Fe_2O_3$) at the ordinaly temperature after cooling, though there are differences in quantities and proportions. A mechanism of removing the scales is, for example, as follows:

$$FeO+2H^+ \rightarrow Fe^{2+}+H_2O$$

However, such a reaction cannot be promoted for a short time unless there is such a stronger acidic state as not more than pH=0 at the ordinary temperature. It has been experimentally found that when the metallic material is at a temperature of not less than 100° C., or more preferably at temperatures in the following order: not less than 120° C., not less than 175° C., not less than 200° C., not less than 250° C., not less than 300° C., not less than 600° C. and not less than 700° C. before cooling, dissolution of iron oxide can be promoted at not less than pH=−2 and also even in such a relatively weak acidic state as not less than pH=0. Tables 1 and 2 show changes in remaining scale rate in relation to pH and electric current. As is evident from Table 2, when a hot metallic material at 100° C. or higher before cooling is subjected to cooling to the ordinary temperature with an aqueous hydrochloric acid solution of pH=4 showing a slight acidic state as an aqueous electrolytic solution, the scales can be removed and suppressed substantially completely.

As is also evident from the results of Table 1, the remaining scale rate can be reduced even in a neutral state of pH=7 by applying an electric current thereto at least at 0.1 $A/m^2$. Application of the electric current to either a positive electrode or a negative electrode is effective.

As a result of additional tests, the present inventors have found that even only application of the electric current or use of only acidic water of pH=−2 to 4 can promote oxide scale removal on metallic materials at a temperature of not less than 100° C. or more preferably at temperatures in the following order: not less than 120° C., not less than 175° C., not less than 200° C., not less than 250° C., not less than 300° C., not less than 600° C. and not less than 700° C., and a combination of application of the electric current with acidic water such as hydrochloric acid, oxidation potential water, etc. can improve a scale removal efficiency.

Furthermore, the present inventors have found that not only in the water cooling step for metallic materials but also in a pickling step for washing metallic materials with an aqueous hydrochloric acid, etc., a pickling efficiency can be increased by increasing the temperature of metallic materials to not less than 100° C., more preferably to temperatures in the following order: not less than 120° C., not less than 175° C., not less than 200° C. and not less than 250° C. before the pickling and further can be improved by applying an electric current thereto. The pickling step means a step of removing metal oxide products with an aqueous acid solution, etc.

Figure 2:
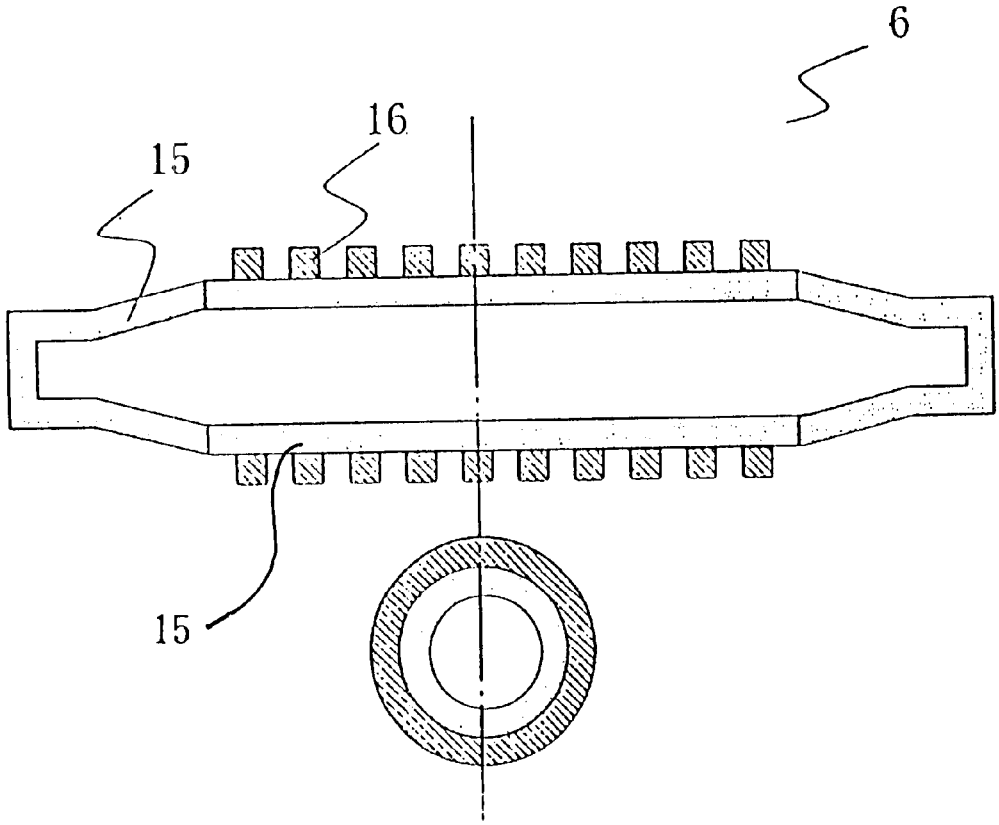
FIG. 2 is a view showing embodiment of a roll used in the appratus accoding to the present invention.
Figure 3:
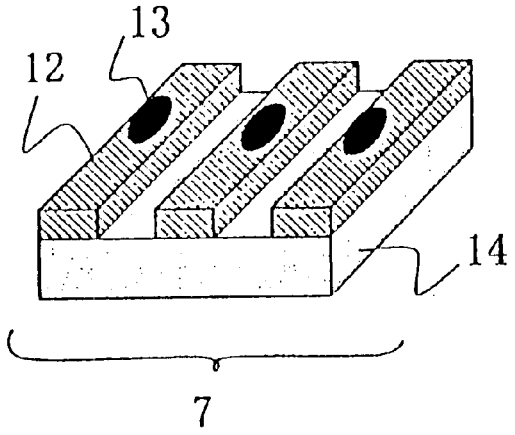
FIG. 3 is a view showing embodiment of an apron guide used in the apparatus according to the present invention.

For example, a process for producing a hot rolled steel sheet will be briefly described below. A slab, 300 mm thick, 1,200 mm wide and 10,000 mm long, is heated in a heating furnace, then rougly rolled to 30 mm thick, 1,200 mm wide and 100,000 mm long, further rolled in a finish rolling mill as a final rolling step, cooled at a predetermined temperature and coiled. In the foregoing process steps, oxide scales on the steel sheet surface are removed once by descaling with high pressure water just before the finish rolling mill, but due to exposure to a large amount of water present in the finish roll mill and the throughput time, scales are formed to a thickness of a few to ten odd $\mu$m just after the finish rolling mill, whereas in the cooling step usually using water as cooling water, oxidation proceeds by water vapors. To remove oxide scales formed in the finish rolling mill and also oxide scales formed in the cooling step, pinch rolls 2 for electrically charging a steel sheet 11 to act as the negative electrode are provided on the outlet side of a rolling mill 1, as shown in FIG. 1. In the cooling step, rolls 6 comprising projections of resin insulators 16 in contact with the steel sheet 11 and recesses of copper plate electric conductor 15, as shown in FIG. 2, and apron guides 7 in non-electric contact with the steel sheet 11 through insulators 12, as shown in FIG. 3, are used to avoid direct contact with the electrically charged steel sheet 11 to act as the negative electrode. Side guides 3 are provided at side edges of the steel sheet to prevent leakage of cooling water from the sides. An electric current is passed from the steel sheet 11 through the cooling water to the recesses of copper plate electric conductor 15 and/or aprons 14 for electrode steel sheet of apron guides 7.

After the cooling step, a descaling header 5*a* is provided, and water is shut off by a drain wiper 5 provided thereafter, and further a rinsing device 9 using hot water and an oiler device 8 using mineral oil, etc. are provided thereafter to obtain the steel sheet free from oxide scales formed in the hot rolling process.

According to the invention of the aforementioned item (1), a direct current or an alternating current is applied at 0.1 to $10^5$ A/m$^2$ of unit surface area in the water cooling step of a metallic material at temperatures of 100° to 1,200° C. Metal dissolution reaction rate or oxide reduction reaction increases as an exponential function of temperature, and a higher dissolution reaction rate, which cannot be obtained by the conventional pickling with an upper temperature limit of 100° C., can be attained by increasing the temperature of metallic materials to not less than 100° C.

On the other hand, a higher metallic material temperature than 1,200° C. at the start of water colling is not practical, because the current application means can no longer maintain a heat strength at such a temperature.

Furthermore, electrochemical reactions can be promoted by passing an electric current to the metal surfaces. Dissolution reaction of metals, for example, $Fe \rightarrow Fe^{2+}+2e^-$ or reduction reaction of oxides, for example, $4FeO \rightarrow Fe^{2+}+Fe_3O_4$, are eletrochemical reactions, where the reaction rate can be increased by applying an electric current thereto. Thus, scales can be efficiently removed by applying a direct current or an alternating current at least at 0.1 A/m$^2$ of unit surface area. Below 0.1 A/m$^2$, the reaction rate is not sufficient for scale removal, and thus at least 0.1 A/m$^2$ must be used. When the electric current is applied above $10^5$ A/m$^2$, on the other hand, generation of hydrogen due to electrolysis of water is vigorous, and thus a current density of not more than $10^5$ A/m$^2$ must be used from the viewpoint of safety.

In the present invention, application even of positive or negative potential has an effect on scale removal, and thus scale removal reaction can proceed by application not only of a direct current, but also of an alternating current (where application of a negative potential means changing a positive electrode to a negative electrode by shifting the direction of electric current with a positive potential or changing a negative electrode to a positive electrode).

Usually, the reaction rate is directly controlled, and thus it is preferable to apply a direct current, but an alternating current can be applied on the aforementioned grounds. However, there is a delay in the time in electrochemical reactions and thus it is preferable for efficient scale removal to use a low frequency of not more than 10 Hz.

Chemical reaction mechanism is different between the positive electrode and the negative electrode. When an alternating current is applied to make the front and back sides of a metallic material uniform, the positive electrode reaction and the negative electrode reaction take place in an electrically alternate manner, so that a special arrangement of the positive electrode and the negative electrode can be unnecessitated for smoothening of metallic material surfaces.

According to the invention of the aforementioned item (2), hydrogen generation rate and metal dissolution reaction rate are increased during the cooling with cooling water of pH=4 or less, in the water cooling step of a metallic material at temperatures of 100° to 1200° C. as compared with that of pH=7. With decreasing pH, the reaction rate of $2H^++2e^- \rightarrow H_2$ as a negative electrode reaction is increased, so that $H_2$ is much more generated between the scales and the iron material, thereby ensuring the scale removal. The reason for restricting the temperature range for the metallic material is the same as above as to (1). Above pH=4, the dissolution reaction rate and the hydrogen gas generation rate are not satifcatory for scale peeling and thus pH is limited to not more than 4. Below a pH=−2, on the other hand, there are an increased risk of acid handling and an increased possibility of corrosion of neighboring facility, and thus the pH is limited to not less than −2.

The invention of the aforementioned item (3) is limited to a combination of the current density set forth in the invention of the aforementioned item (1) with the pH range set forth in the aforementioned item (2), whereby scales can be more efficiently removed due to a synergistic action of the current density and the pH range.

The invention of the aforementioned item (4) relates to application of electricity. As shown in FIG. 1, pinch rolls 2 are provided on the outlet side of a rolling mill 1 to electrically charge a steel sheet 11 to act as a negative electrode, and rolls 6 or apron guides 7 insulated from the steel sheet 11 are provided behind the pinch rolls 2 to act as a positive electrode, thereby ensuring efficient scale removal. Even switching of electrode function between the positive electrode and the negative electrode is effective similarly, as shown in Example 1 (Table 1).

Figure 4:
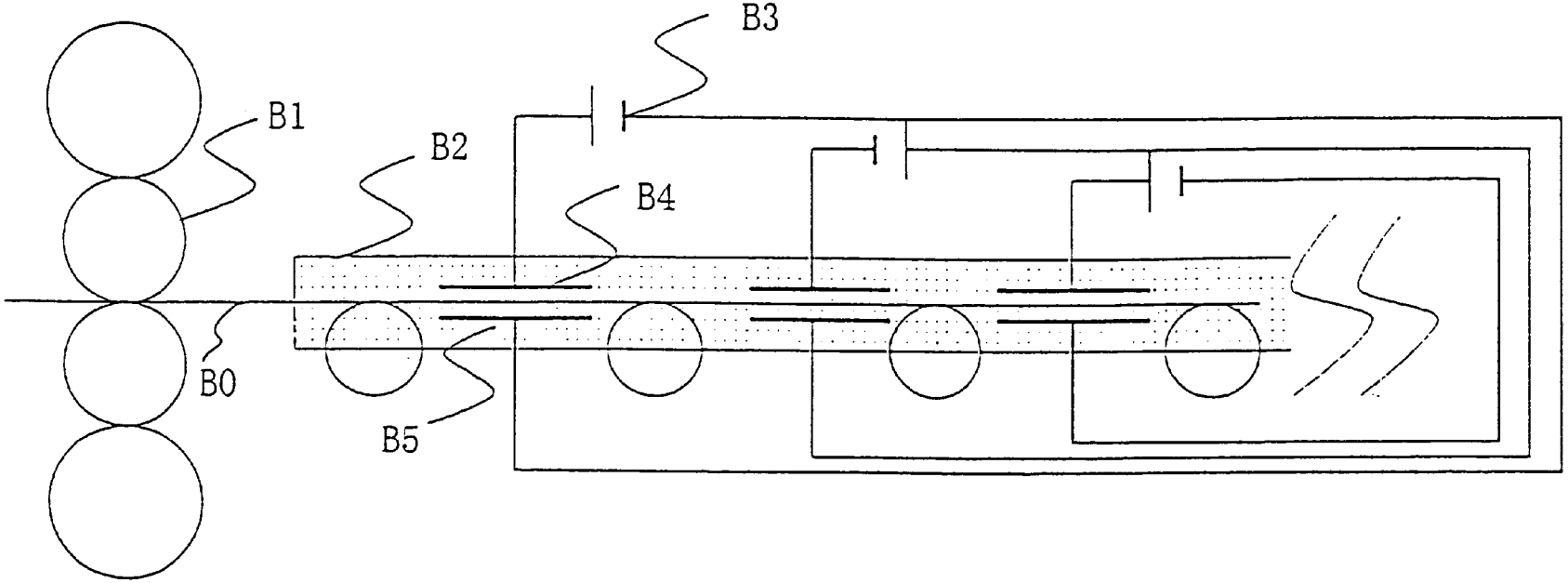
FIG. 4 is a view showing an embodiment of the apparatus according to the present invention.

Furthermore, as shown in FIG. 4, when a metallic material B0 leaving a finish rolling mill B1 is arranged between a positive electrode plate B4 and a negative electrode plate B5 relative to a power source B3 provided in a water cooling tank B2, the electric current is passed from the positive electrode plate B4 to the negative electrode plate B5 through the metallic material B0, where the possitive electrode-facing side of the metallic material B0 acts as a negative electrode, whereas the negative electrode-facing side of the metallic material B0 acts as a positive electrode and thus scales can be removed by the action as described above referring to the invention of the aforementioned item (1). Furthermore, when pairs of the positive electrode plate and the negative electrode plate are alternately arranged, as shown in FIG. 4, the front side and the backside of the metallic material can be made to have uniform state.

In the invention of the foregoing item (6), it is necessary to pass an electric current, which can cause the necessary eletrochemical reactions for the scale removal, between the electrode and the metallic material through the cooling water, and thus the electric conductivity is limited to 0.01 S/m or more. When the electric conductivity exceeds 100 S/m, the facility undergoes considerable corrosion, and thus it is limited to not more than 100 S/m.

In the invention of the foregoing item (7), cooling water deaerated to a dissolved oxygen concentration of not more than $4.46\times10^{-5}$ mol/m$^3$ (1 ppm) is used, because a metallic material is oxidized not only by water vapors but also by dissolved oxygen to form scales during the water cooling. On the other hand, even a dissolved oxygen concentration of 0 mol/m$^3$ (0 ppm) can attain the effect of the present invention, and thus there is no longer limit thereto.

In the inventions of the aforementioned items (1) to (7), scales are peeled off the metallic material in a buoyant state, and thus the scale removal can be further increased by allowing high pressure water to hit the scales to promote scale peeling. Thus, in the invention of the aforementioned item (8), the metallic material is hit with high pressure water under pressure of 0.2942 to 49.03 MPa during the cooling. A hitting pressure of less than 0.2942 MPa is lower than the force of adhesion between the scales and the iron material and is not effective for the scale peeling. A hitting pressure of more than 49.03 MPa requires much electric power for the pressurization and thus is not economically preferable. Thus, it is limited to the aforementioned range.

In the invention of the aforementioned item (8), descaling with high pressure water can be carried out at any stage of water cooling, i.e. initial stage, intermediate stage or final stage, and simple water can be used as cooling water in the present invention, but preferably when cooling water set forth in the aforementioned items (2), (6) and (7) as explained or (10), (11), (12), (13), (14), (15) and (16), as will be fully explained later on, is used, the descaling effect can be further improved.

In the inventions of the aforementioned items (1) to (8), scales are peeled off the metallic material in a buoyant state or even unpeeled scales partly lose the force of adhesion to the iron material. In the invention of the aforementioned item (10), hitting with high pressure water can thus peel and remove the scales even after the cooling of the metallic material. Reasons for limiting the hitting pressure range of high pressure water and kinds of high pressure water are the same as in the invention of the aforementioned item (8).

In the invention of the aforementioned item (10), gas generation on the metallic material surface can enhance scale removal, because gas generation on the boundary between the scales and the iron material exerts an action of pushing the scales upwards. To prevent new scale formation, the gas is limited to a non-oxidative gas or a low oxidative gas. Thus, cooling water containing at least one of hydrogen, ammonia, nitrogen, carbon dioxide and an inert gas such as He, Ne, Ar, etc. at a total dissolved gas concentration of $4.46\times10^{-5}$ to $2.23\times10^{-4}$ mol/m$^3$ (1 to $5\times10^4$ ppm) is used. When the dissolved gas concentration is less than $4.46\times10^{-5}$ mol/m$^3$ (1 ppm), the gas generation rate is not satisfactory for the scale peeling and it is also impossible to dissolve a gas in high pressure water at a dissolved gas concentration of more than $2.23\times10^{-4}$ mol/m$^3$ ($5\times10^4$ ppm).
Thus, the dissolved gas concentration is limited to the aforementioned range.

In the invention of the aforementioned item (11), hydrochloric acid, sulfuric acid or nitric acid is added to cooling water to simply adjust pH. The pH of the cooling water must be adjusted to not more than 4 by the addition thereto, as explained above in reference to the invention of the aforementioned item (2).

According to the invention of the aforementioned item (15), the uniformly scale-removed surface can be obtained due to reaction time at high temperatures and reaction surface-stirring effect by vapor generation.
The surface temperature of the metallic material is hardly lowered by setting the cooling water temperature to 50° C. or higher, so that the scale removal reaction can proceed more efficiently. When the cooling water temperature exceeds 100° C., there appears a boiling state, giving a trouble to facility operations.

In the invention of the aforementioned item (16), circulation of react cooling water with fresh one can be efficiently carried out in the reaction by setting a relative speed of the cooling water and the metallic material to each other to 0.1 m/s or more, producing the same effect as the stirring effect. That is, uniformly scale-removed surfaces can be obtained. When the relative speed exceeds 300 m/s, on the other hand, the aforementioned stirring effect can be obtained, but the facility cost is inevitably increased. Thus, the upper limit is set to 300 m/s. "Relative speed" means a speed of cooing water to a metallic material or a speed of a metallic material to cooling water in the travelling direction of a metallic material.

In the inventions of the aforementioned items (12) and (13), an oxidizing agent includes, for example, $H_2O_2$, $HNO_3$, $HClO_4$, $O_3$, etc., and the present inventors have found that cooling water is effective, if its ORP value is not less than 0.5, but is costly, if the ORP value exceeds 2.

A reducing agent includes, for example, $H_2$, $Na_2$ $SO_3$, $FeSO_4$, etc., and the present inventors have found that cooling water is effective, if its ORP value is not more than −0.5, and is costly, if the ORP value is less than −1.5.

Furthermore, it has been found that the surfaces can be finished smooth by alternately and repeatedly using cooling water adjusted to an ORP value of 0.5 to 2 by an oxidizing agent and cooling water adjusted to an ORP value of −0.5 to −1.5 by a reducing agent.

In the invention of the aforementioned item (14), oxidation potential water is partly or wholely used for the cooling water to eliminate use of acid, thereby giving no harm to the environment and unnecessitate any waste acid treatment, thereby reducing the running cost. "Oxidation potential water" means acidic water with pH=−2 to 4, containing hypochlorous acid formed at the positive electrode when water is electrolyzed.

In the invention of the aforementioned item (17), rinsing with a liqiud and/or a gas, for example, washing water resulting from cleaning runout table cooling water, such as boron-containing water and/or $N_2$, etc. and rust-proof treatment with beef tallow, etc. are carried out just after removal of oxide scales formed on the metallic material during the hot rolling or cooling, and thus any other steps can be unnecessitated, thereby ensuring throughout production of steel materials. That is, timely efficient production of steel materials can be attained.

In the invention of the aforementioned item (18), rust-proof treatment is carried out with beef tallow, mineral oil or chemical synthesis oil, each containing 0.0001 to 1% by weight of boron to prevent scale formation after the water cooling. When the boron content is less than 0.0001% by weight, suppression of scale formation is not satisfactory, whereas the boron content of more than 1% by weight is over solubilities of boron compounds, rendering their application difficult. Thus, the boron content is limited to the aforementioned range.

In the invention of the aforementioned item (25), an electric current is passed in the longitudinal direction of a steel material by pinch rolls as negative electrodes on the outlet side of a hot rolling mill, whereas positive electrodes are given by rolls or apron guides provided behind the pinch rolls and being in a non-electric contact with the steel material, through insulators. Since there is no direct contact between the positive electrodes and the negative electrodes, oxide scales formed during the hot rolling or cooling can be stably removed.

In the invention of the aforementioned item (26), the positive electrodes are given by the pinch rolls on the outlet side of the hot rolling mill, whereas the negative electrodes are given by the rolls or apron guides provided behind the pinch rolls. In this structure, scales can be also efficiently removed through dissolution reactions of the metallic material.

In the invention of the aforementioned item (20), a metallic material heated to 100° to 700° C. beforehand or a metallic material at a temperature of 100° to 700° C. from the beginning is subjected to a pickling treatment. Since the temperature of the metallic material exceeds 100° C., which is an upper limit of the conventional pickling temperature, the pickling time can be largely shortened, as compared with the conventional pickling time.

Heating can be carried out by direct electric heating, induction heating, transformer effect type electric heating, burner heating, steam heating, etc.

Hydrochloric acid, sulfuric acid, nitric acid, hydrofluoric acid, etc. can be used as an acid for the pickling, and thus the pickling can be carried out faster than the conventional pickling, so that the pickling can be efficiently carried out at a concentration, for example, pH=−2 to 2.7, which is lower than the usual concentration.

Pickling of a metallic material at a temperature of less than 100° C. belongs to the conventional pickling, whereas pickling at a temperature of more than 700° C. oxidizes the metallic material, resulting in scale formation.

Thus, the pickling temperature is limited to the aforementioned range.

In the invention of the aforementioned item (20), a direct current or an alternating current is applied to a metallic material heated to 100° to 700° C. beforehand or a metallic material at a temperature of 100° to 700° C. from the beginning, whereby the pickling can be carried out faster than the conventional pickling. That is, the pickling can be conducted efficiently at a lower concentration than the usual concentration. Application of a direct current or an alternating current at least at 0.1 $A/m^2$ of unit surface area can increase a metallic material dissolution reaction rate or a scale reductive dissolution reaction rate, which preferably ensures efficient scale removal. An upper limit to the current density is preferably less than $10^5$ $A/m^2$, because an increased hydrogen gas generation rate produces a higher risk of flash explosion.

Usually, it is preferable for the direct control of reaction rate to use a direct current, but an alternating current may be used, because a scale removal effect can be equally obtained irrespective of the polarity, i.e. positive electrode or negative electrode as played by a metallic material. However, there is a time delay in the electrochemical reaction, and it is preferable for efficient scale removal to use a low frequency of not more than 10 Hz.

Efficient pickling can be carried out by making a metallic material act as a positive electrode and making electrode provided near the metallic material in a pickling tank act as a negative electrode and vice versa or by providing the metallic material between a positive electrode and a negative electrode provided in the pickling tank.

Description will be made in detail below, referring to FIG. 5.

Figure 5:
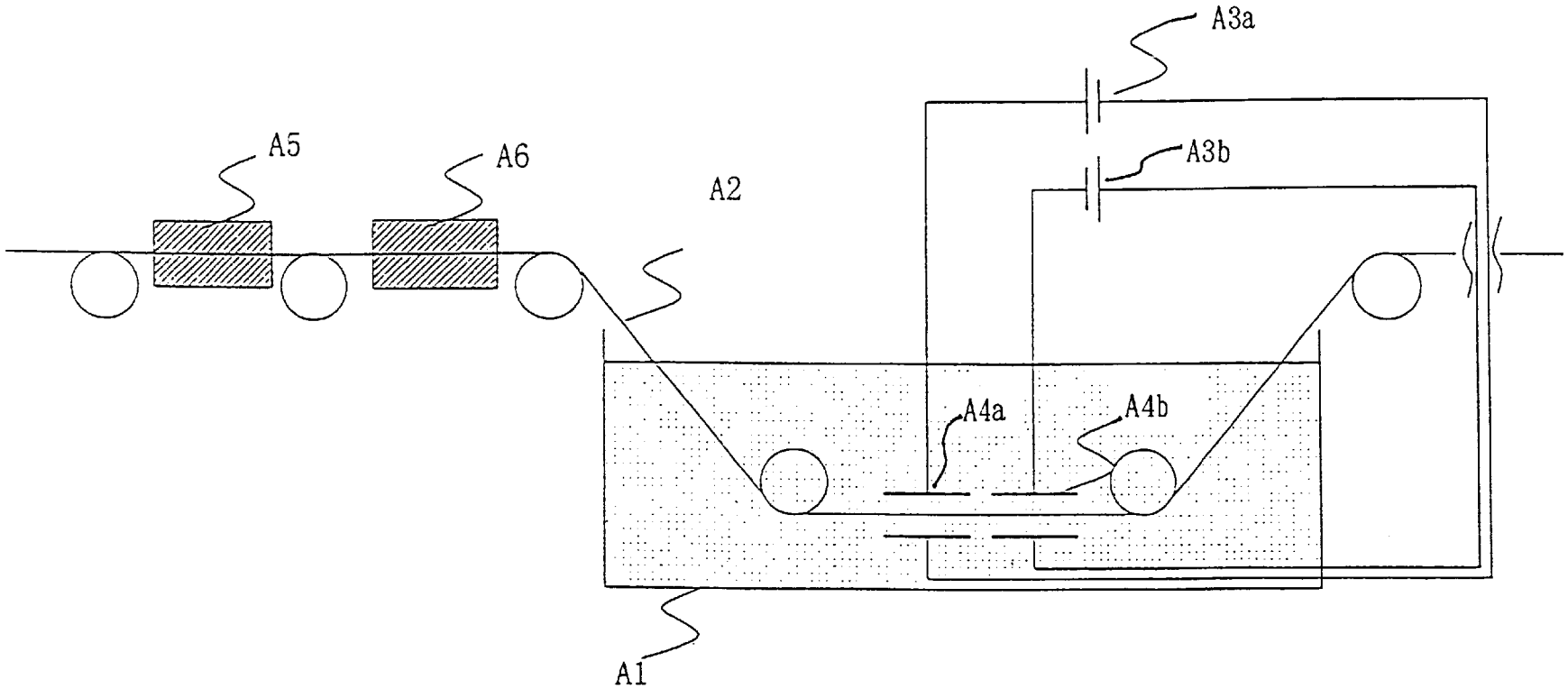
FIG. 5 is a view showing an embodiment of the apparatus according to the present invention.

FIG. 5 shows an outline of a pickling tank A1. A metallic material A2, if at the ordinary temperature before entering into the pickling tank A1, is heated to a range of the ordinary temperature and 100° C. by a steam preheater A5 for injecting steam and further preferably heated to a range of 100° C. and 250° C. by an induction heater A6.

No heating is made if the metallic material temperature exceeds 100° C. The metallic material A2, heated or not heated when required, is subjected to electrochemical operations by providing power sources A3*a* and A3*b* and passing the metallic material A2 through between electrodes A4*a* acting as a positive electrode and a negative electrode, respectively, and then through between electrodes A4*b* acting as a negative electrode and a positive electrode, respectively.

Reason for limiting the temperature range of a metallic material, heating methods and pickling methods are the same as mentioned in reference to the invention of the aforementioned item (19).

In the invention of the aforementioned item (22), the metallic material following the water cooling step in the processes of the aforementioned items (1) to (14) is subjected to an acid treatment and then coiled, whereby complete scale removal can be attained in a continuous single process.

In the present invention, the metallic material temperature is a surface temperature of a metallic material, and measurments are made by a radiation thermometer, etc., at the center in the lateral direction, if it is in a plate form, or at the upper part, if it is in a wire form.

EMBODIMENTS

EXAMPLE 1

In this Example, the present invention was carried out under the following conditions:

Test pieces (sheet size): steel materials, 2 mm thick×10 mm width×10 mm long

Test conditions: Test pieces were heated in a heating furnace so that quantities of initially formed scales could amount to 2, 6 and 10 $\mu$m at the respective cooling initiation temperatures. Then, the test pieces were taken out of the heating furnace. The test pieces adjusted to temperatures of 1,200°, 900°, 600°, 300° and 100° C., respectively, and the test piece at room temperature (20° C. ) were cooled by dipping into 2 L (liter) of industrial water adjusted to a pH of 7 at direct current densities of $-10^5$, $-10^4$, −1,000, −100, −10, −1, −0.1, −0.01, 0, 0.01, 0.1, 1, 10, 100, 1000, $10^4$, and $10^5$ $A/m^2$, respectively, and quantities of scales on the test piece surfaces at room temperature were measured. Positive current densities mean that the test pieces act as and positive electrodes.

Negative current densities mean reversing of electric current direction to the opposite, showing that the test pieces act as negative electrodes (that is, it shows that the current densities are positive values and the test pieces act as negative electrodes).

No high pressure water was made to hit the steel materials. Cooling water temperature was 30° C. A relative speed of the cooling water and the steel material to each other was set to 0 m/s.

Conditions for the cooling water (that is, the industrial water adjusted to pH=7) are as follows:

Electric conductivity of cooling water: 3 S/m

Dissolved oxygen concentration of cooling water: $2.23\times10^{-4}$ $mol/m^3$ (5 ppm)

Hitting pressure of cooling water: 0.2942 MPa

Dissolved gases in cooling water other than oxygen [nitrogen: $4.46\times10^{-4}$ $mol/m^3$ (10 ppm); carbon dioxide: $6.69\times10^{-4}$ $mol/m^3$ (15 ppm)]

Test results are shown in Table 1 and remaining scale rate is given by the following equation (1):

$$\text{Remaining scale rate} = \text{scale quantity [g] at the ordinary temperature/initial scale quantity [g]} \times 100\% \quad (1)$$

TABLE 1

Remaining scale rate in Example 1

| Current density A/m$^2$ | Temp. 20° C. | Temp. 100° C. | Temp. 300° C. | Temp. 600° C. | Temp. 900° C. | Temp. 1200° C. |
|---|---|---|---|---|---|---|
| $-10^5$ | Δ | ○ | ○ | ○ | ○ | ○ |
| $-10^4$ | Δ | ○ | ○ | ○ | ○ | ○ |
| −1000 | Δ | ○ | ○ | ○ | ○ | ○ |
| −100 | Δ | ○ | ○ | ○ | ○ | ○ |
| −10 | Δ | ○ | ○ | ○ | ○ | ○ |
| −1 | Δ | ○ | ○ | ○ | ○ | ○ |
| −0.1 | X | ○ | ○ | ○ | ○ | ○ |
| −0.01 | X | X | X | X | Δ | Δ |
| 0 | X | X | X | X | X | X |
| 0.01 | X | X | X | Δ | Δ | Δ |
| 0.1 | X | ○ | ○ | ○ | ○ | ○ |
| 1 | Δ | ○ | ○ | ○ | ○ | ○ |
| 10 | Δ | ○ | ○ | ○ | ○ | ○ |
| 100 | Δ | ○ | ○ | ○ | ○ | ○ |
| 1000 | Δ | ○ | ○ | ○ | ○ | ○ |
| $10^4$ | Δ | ○ | ○ | ○ | ○ | ○ |
| $10^5$ | Δ | ○ | ○ | ○ | ○ | ○ |

○: Remaining scale rate: less than 5%
Δ: Remaining scale rate: 5–20%
X: Remaining scale rate: over 20%

The results revealed that the remaining scale rate was small at a cooling initiation temperature of 100° C. or higher and a direct current density of 0.1 to $10^5$ A/m$^2$, and Comparative Examples using room temperature as a cooling initication temperature were less effective. Test pieces made to act as a positive electrode or a negative electrode were found effective.

EXAMPLE 2

In this Example, the present invention was carried out under the following conditions:

Test pieces (sheet size): steel materials, 2 mm thick×10 mm wide×10 mm long

Test conditions: Test pieces were heated in a heating furnace so that quantities of initially formed scales could amount to 6 $\mu$m at the respective cooling initiation temperatures. Then, the test pieces adjusted to the temperatures in an non-oxidative atmosphere were taken out of the heating furnace and the test pieces heated to 1200°, 900°, 600°, 300° and 100° C. and a test piece at room temperature (20° C.) were cooled by dipping into 2 L (liter) each of aqueous hydrochloric acid solutions each adjusted to pH=−2, 0, 2, 4 and 6 by hydrochloric acid in advance, respectively, and scale quantities on the test piece surfaces at the ordinary temperature were measured. No high pressure water was made to hit the steel material. Cooling water temperature was set to 30° C., and a relative speed of cooling water and the steel material to each other was set to 0 m/s.

Conditions for cooling water (that is, aqueous hydrochloric acid solutions adjusted to pH=−2, 0, 2, 4 and 6, respectively, by hydrochloric acid in advance) are shown below:

Electric conductivity of cooling water: 3 S/m

Dissolved oxygen concentration of cooling water: 2.23×$10^{-4}$ mol/m$^3$ (5 ppm)

Hitting pressure of cooling water: 0.294 MPa

Dissolved gases in cooling water other than oxygen (nitrogen: 4.46×$10^{-4}$ mol/m$^3$ (10 ppm); carbon dioxide: 6.69×$10^{-4}$ mol/M$^3$ (15 ppm))

Test results are shown in Table 2. Remaining scale rate is given by the following equation (1):

$$\text{Remaining scale rate} = \text{scale quantity (g) at the ordinary temperature} / \text{initial scale quantity (g)} \times 100\% \quad (1)$$

TABLE 2

Remaining scale rate in Example 2

| pH | Temp. 20° C. | Temp. 100° C. | Temp. 300° C. | Temp. 600° C. | Temp. 900° C. | Temp. 1200° C. |
|---|---|---|---|---|---|---|
| −2 | Δ | ○ | ○ | ○ | ○ | ○ |
| 0 | X | ○ | ○ | ○ | ○ | ○ |
| 2 | X | ○ | ○ | ○ | ○ | ○ |
| 4 | X | ○ | ○ | ○ | ○ | ○ |
| 6 | X | X | X | X | Δ | Δ |

○: Remaining scale rate: less than 5%
Δ: Remaining scale rate: 5–20%
X: Remaining scale rate: over 20%

The results revealed that the remaning scale rate was small at a cooling initiation temperature of 100° C. or higher and a pH of 4 or less, and Comperative Example using the cooling initiation temperature of 20° C. or pH=6 were less effective.

EXAMPLE 3

Embodiments of the apparatus according to the present invention will be described in detail below, referring to FIGS. 1 to 3.

Pinch rolls 2 provided behind a rolling mill 1 electrically charge a steel sheet 11 as a positive elecrode and peripheral sizes of the steel sheet 11, i.e. edge sides and lower side, are fenced with side guides 3, and rolls 6 and apron guides 7, respectively.

Water used in the cooling, which contains iron ions, etc. as dissolved therein, and has an electric conductivity of 0.01 S/m, is recycled as cooling water. The cooling water is adjusted to a pH of approximately 0 to 2.5 by electrolysis of water in advance, thereby obtaining oxidation potential water. The oxidation potential water is injected from cooling headers 4 and apron guides 7 to cool the travelling steel sheet 11 and suppress and remove scales as well by controlling the electric current, depending upon the degree of scale removal.

Apron guides 7 each comprise insultaros 12 with cooling nozzles 13 and are electrically charged as positive electrodes through aprons 14 for electrode steel sheet. Rolls 6 each comprise an electric conductor 15 electrically charged as a positive electrode, but are prevented from direct contact with the steel sheet 11 electrically charged as a negative electrode by resin insulators 16. To clean the buoyant scales on the surface of the steel sheet 11, a descaling header 5*a* is provided, thereby applying a mechanical force thereto.

To control a coiling temperature at a coiler 10, the electrolytic water is successively drained off the steel sheet 11 by a drain wiper 5. The electrolytic water is removed from the surface of the steel sheet 11 by a rinsing device 9 comprising at first hitting water the steel sheet 11 in the lateral direction through cooling nozzles 13 to remove the electrolytic water and then drying the steel sheet 11 by dry air. The steel sheet 11 leaving the rinsing device 9 is, if required, coated with mineral oil through an oiler device 8 for applying the mineral oil to the steel sheet surface and then coiled onto a coiler 10. By incorporating the aforementioned apparatus at the hot rolling process, suppression and removal of scales can be efficiently carried out, largely shortening the pickling treatment time as a successive step. The foregoing embodiment was carried out under the following conditions: cooling initiation temperature: 880° C., voltage: 100V and direct current density: 0.5 A/cm$^2$. Travelling speed of the steel sheet 11 in the cooling step was 8.33 to 33.33 m/s.

Conditions for cooling water from cooling headers and cooling water as high pressure water as mentioned below are as follows:

Cooling water temperature: 30° C.

Relative speed of the cooling water and the steel sheet to each other: 0 m/s.

High pressure water under 0.9807 MPa (the same water as the cooling water) was made to hit the steel material at the final stage of water cooling.

Electric conductivity of cooling water: 3 S/m

Dissolved oxygen concentration of cooling water: $2.23\times10^{-4}$ mol/m$^3$ (5 ppm)

Hitting pressure of cooling water: 0.294 MPa

Dissolved gases in cooling water other than oxygen [$N_2$ concentration: $4.46\times10^{-4}$ mol/m$^3$ (10 ppm) and $CO_2$ concentration: $6.69\times10^{-4}$ mol/m$^3$ (15 ppm)].

EXAMPLE 4

In this Example relating to oxidation potential water, the present invention was carried out under the following conditions:

Test pieces (sheet size): steel materials, 2 mm thick×10 mm wide×10 mm long

Test conditions: Test pieces were heated in a heating furnace so that quantities of initially formed scales could amount to 6 $\mu$m at the respective cooling initiation temperatures. Then, the test pieces were taken out of the heating furnace, and test pieces heated to 1200°, 900°, 600°, 300° and 100° C., respectively, and a test piece at room temperature (20° C.) were cooled by dipping into 2 L (liter) of acidic water of a pH of 2 (oxidation potential water) containing hypochlorous acid formed at the anode by electrolysis of water, to which sodium chloride was added in advance, and quantities of scales on the surfaces of test pieces at room temperature were measured. High pressure water was made to hit the steel materials under hitting pressure of 0.980 Mpa after the cooling.

Conditions for cooling water [acidic water of a pH of 2 (oxidation potential water) formed at the anode by electrolysis of water, to which sodium chloride was added in advance] and cooling water as high pressure water are given below:

Conductivity of cooling water: 0.150 S/m

Dissolved oxygen concentration of cooling water: $1.338\times10^{-4}$ mol/m$^3$ (3 ppm)

Hitting pressure of cooling water: 0.294 MPa

Dissolved gases in the cooling water other than oxygen [nitrogen: $2.230\times10^{-4}$ mol/m$^3$ (5 ppm) and carbon dioxide: $1.784\times10^{-4}$ mol/m$^3$ (4 ppm)]

Cooling water temperature:

Relative speed of cooling water and steel sheet to each other: 0 m/s

Test results are shown in Table 3. It was found that remaining scale rate was small at a temperature of 100° C. or higher and substantially same results as those of Example 2 showing pH adjustment with hydrochloric acid could be obtained.

TABLE 3

| Remaining scale rate in Example 4 | | | | | |
|---|---|---|---|---|---|
| Temp. 20° C. | Temp. 100° C. | Temp. 300° C. | Temp. 600° C. | Temp. 900° C. | Temp. 1200° C. |
| X | ○ | ○ | ○ | ○ | ○ |

○: Remaining scale rate: less than 5%
Δ: Remaining scale rate: 5–20%
X: Remaining scale rate: over 20%

EXAMPLE 5

An embodiment of the invention of the aforementioned item (19) will be described below, referring to FIG. 5. FIG. 5 shows an outline of a pickling tank. When a metallic material A2 is at the ordinary temperature before entering into a pickling tank A1, the metallic material A2 is heated for a range of the ordinary temperature and 100° C. by steam injection through a steam preheater A5, and for a range of 100° and 250° C. through an induction heater A6. When the metallic material A2 is at a temperature higher than 100° C. from the beginning, no heating is made.

In this Example, the steel material was set to 250° C. before the pickling and no electric current was applied thereto. The acid was an aqueous sulfuric acid solution at an acid concentration of pH=0.

The aqueous acid solution was set to 30° C., and a relative speed of the aqueous acid solution and the steel sheet to each other was set to 0 m/s. In comparison with Comparative Example using the aqueous sulfuric acid solution at 90° C., the descaling end time was shortened to about 1/100 in case of heating at 250° C.

EXAMPLE 6

An embodiment of the invention of the aforementioned item (20) will be described below, also referring to FIG. 5. Power sources A3*a* and A3*b* were additionally provided, and a metallic material was passed through between electrodes A4*a*, as a positive electrode and a negative electrode, and electrodes A4*b*, as a negative electrode and a positive electrode, to conduct electrochemical operations.

In this Example, a direct current density was specifically set to 5,000 A/m$^2$ and steel material temperature before the pickling was set to 250° C.

The metallic material, if it was at the ordinary temperature, was heated for a range of the ordinary temperature and 100° C. by steam injection and for a range of 100° C. and 250° C. by an induction heater. The acid was an aqueous sulfuric acid solution and the acid concentration was pH=0 [unit]. Aqueous acid solution temperature was 30° C. and the relative speed of the aqueous acid solution and the steel sheet to each other was 0 m/s. In comparison with Comparative Example using the aqueous hydrochloric acid solution at 90° C., descaling end time was shortened to about 1/200 in case of heating at 250° C.

EXAMPLE 7

Figure 6:
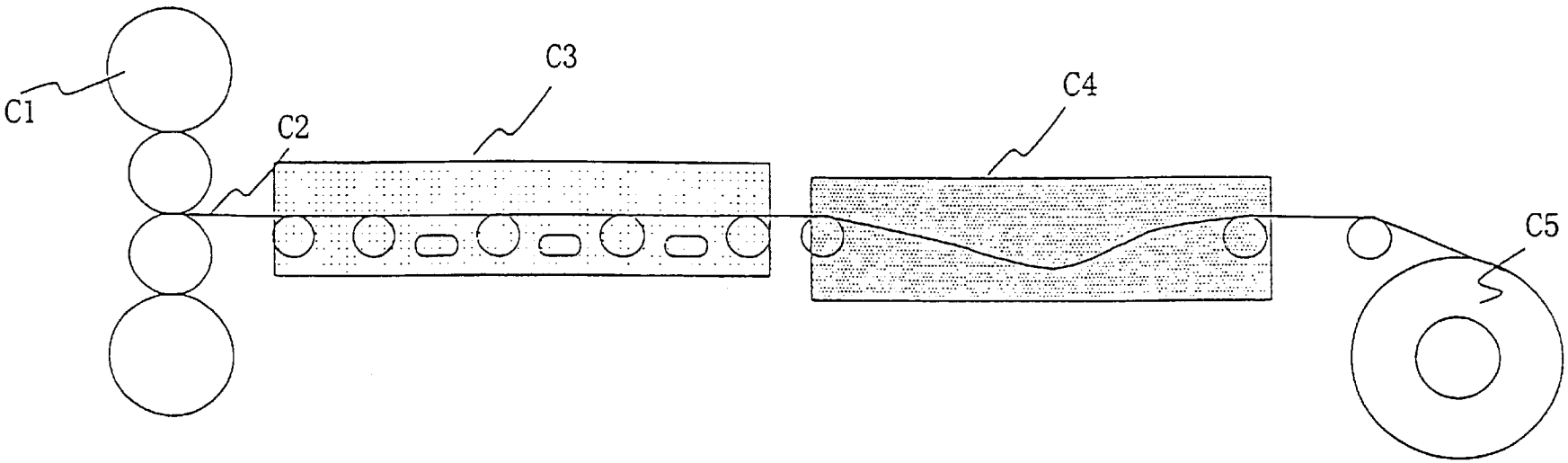
FIG. 6 is a view showing an embodiment of the apparatus according to the present invention.
Figure 7:
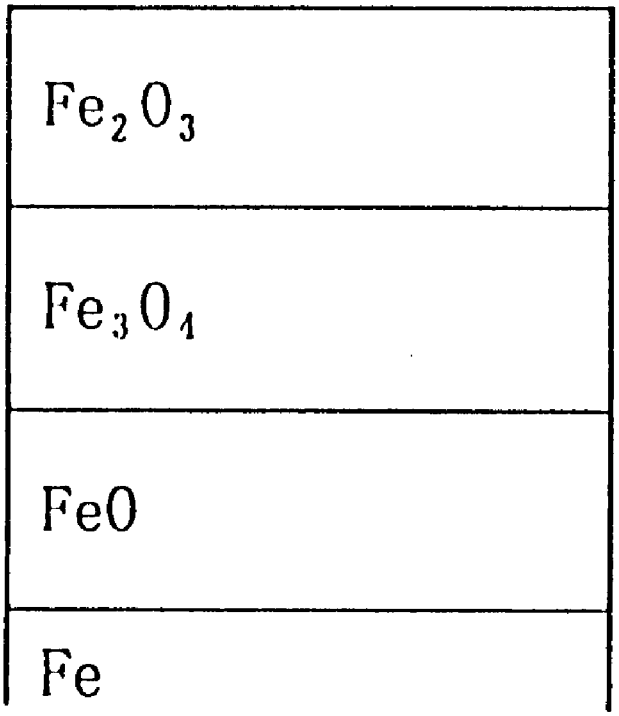
FIG. 7 is a view conceptually showing a scale formation state on a steel material surface.

An embodiment of the invention of the aforementioned item (20) will be described below, referring to FIG. 6. A metallic material C2 leaving a finish rolling mill C1 was subjected to water cooling C3 as given in Example 1, and then additionally passed through a pickling tank C4, followed by coiling into a coil C5. In this Example, the steel material temperature at the end of water cooling C3 was set to 550° C. Comparison was made between the case of passing through the pickling tank C4 and the case of non-passing. It was found that 100% descaling could be attained in case of passing through the pickling tank C4, whereas the reamining scale thickness was 7 μm in case of conducting only water cooling C3 with cooling water of pH=6 without applying an electric current without passing through the pickling tank C4.

The operation was carried out at a cooling water temperature of 30° C. and a steel material travelling speed of 10 to 20 m/s, that is, a relative speed of the cooling water and the steel material to each other of approximately 10 to 20 m/s.

EXAMPLE 8

In this Example relating to cooling water temperature and relative speed, the present invention was carried out under the following conditions:

Test pieces (sheet size): steel material, 2 mm thick×10 mm wide×10 mm long

Test conditions: Test pieces were heated in a heating furnace so that quanties of initially formed scales could amount to 6 μm at the respective cooling initiation temperatures. Then, the test pieces were taken out of the heating furnace, and the test pieces heated to 900° C. were cooled by dipping into 2 L (liter) of acidic water (oxidation potential water) of pH=0.6.

Remaining scale quanties on the test piece surface at the ordinary temperature were measured. A relative speed of cooling water to steel material was used for the relative speed.

Relative hitting speed of cooling water: 0, 0.1 and 300 m/s

Cooling water temperature: 20, 50 and 90° C.

Test results are shown in Table 4. Remaining scale rates were found small at a cooling water temperature of 50° C. or higher and the remaining scale rate was reduced to 0% when stirring was conducted at 0.1 m/s or more.

TABLE 4

| | Relative speed (m/s) | | |
|---|---|---|---|
| Cooling water temp. | 0 | 0.1 | 300 |
| 20 | 4 | 0 | 0 |
| 50 | 0 | 0 | 0 |
| 90 | 0 | 0 | 0 |

Industrial Utility

Effect of the Invention

The present process can suppress oxidation reactions between steel materials and oxygen due to water vapors generated during the cooling and reduce oxides of steel materials so far formed, and thus can remove scales formed by cooling. By using cooling water admixed with sodium chloride as an electrolyte or with hydrochloric acid or sulfuric acid, i.e. an aqueous sodium chloride, hydrochloric acid or sulfuric acid solution as an aqueous electrolytic solution, scales can be removed efficiently with respect to time. When oxidation potential water is used as an aqueous electrolytic solution for the cooling water, no harm will be given to the atmosphere, unnecessitating post-treatment steps for the aqueous electrolytic solution and reducing the running cost.

The present apparatus ensures continuous application of electric current, eliminating short circuit passages of electric current and thus ensuring stable removal of scales formed by water cooling.

By further providing rinsing and the rust-proof means following the cooling step, throughout production of scaleless steel materials can be attained and reduction in the product cost can be also attained.

What is claimed is:

1. A process for removing scales and preventing scale formation on a metallic material comprising:

continuously hot rolling a metallic material, said metallic material having a surface;

providing a cooling water step immediately following exit of the metallic material from the hot rolling;

said cooling water step comprising contacting the surface of said metallic material with cooling water, wherein the surface of said metallic material has a temperature in a range from 200° C. to 1200° C. at time of initial contact with said cooling water;

applying a direct current or alternating current to said metallic material through said cooling water during said cooling step at a current density of 0.1 to $10^5$ A/m$^2$ of unit surface area of said metallic material.

2. A process for removing scales and preventing scale formation on a metallic material comprising:

continuously hot rolling a metallic material, said metallic material having a surface;

providing a cooling water step immediately following exit of the metallic material from the hot rolling;

said cooling water step comprising contacting the surface of said metallic material with cooling water, wherein the surface of said metallic material has a temperature in a range from 200° C. to 1200° C. at time of initial contact with said cooling water; wherein said cooling water has a pH of −2 to 4.

3. A process for removing scales and preventing scale formation on a metallic material comprising:

continuously hot rolling a metallic material, said metallic material having a surface;

providing a cooling water step immediately following exit of the metallic material from the hot rolling;

said cooling water step comprising contacting the surface of said metallic material with cooling water, wherein the surface of said metallic material has a temperature in a range from 200° C. to 1200° C. at time of initial contact with said cooling water; wherein said cooling water has a pH of −2 to 4;

applying a direct current or alternating current to said metallic material through said cooling water during said cooling step at a current density of 0.1 to $10^5$ A/m$^2$ of unit surface area of said metallic material.

4. A process for removing scales or preventing scale formation on a metallic material comprising:

providing a metallic material which has been previously hot rolled, said metallic material having a surface;

providing a pickling step comprising introducing said metallic material into a pickling solution, wherein the surface of said metallic material has a temperature in a range from 200° C. to 700° C. at time of introduction into said pickling solution;

applying a direct current or an alternating current to said metallic material through said pickling solution during said pickling step at a current density of 0.1 to $10^5$ A/m$^2$ of unit surface area of said metallic material.

5. A process for removing scales or preventing scale formation on a metallic material comprising:

providing a metallic material which has been previously hot rolled, said metallic material having a surface;

providing a pickling step comprising introducing said metallic material into a pickling solution, wherein the surface of said metallic material has a temperature in a range from 200° C. to 700° C. at time of introduction into said pickling solution; wherein the pickling solution has a pH of −2 to 2.7.

6. A process for removing scales or preventing scale formation on a metallic material comprising:

providing a metallic material which has been previously hot rolled, said metallic material having a surface;

providing a pickling step comprising introducing said metallic material into a pickling solution, wherein the surface of said metallic material has a temperature in a range from 200° C. to 700° C. at time of introduction into said pickling solution; wherein the pickling solution has a pH of −2 to 2.7;

applying a direct current or an alternating current to said metallic material through said pickling solution during said pickling step at a current density of 0.1 to $10^5$ A/$m^2$ of unit surface area of said metallic material.

7. A process for removing scales and preventing scale formation on a metallic material comprising:

providing a metallic material at an elevated temperature, said metallic material having a surface;

providing a cooling water step for said metallic material at the elevated temperature;

said cooling water step comprising contacting the surface of said metallic material with cooling water, wherein the surface of said metallic material has a temperature in a range from 200° C. to 1200° C. at time of initial contact with said cooling water;

applying a direct current or alternating current to said metallic material through said cooling water during said cooling step at a current density of 0.1 to $10^5$ A/$m^2$ of unit surface area of said metallic material.

8. A process for removing scales and preventing scale formation on a metallic material comprising:

providing a metallic material at an elevated temperature, said metallic material having a surface;

providing a cooling water step for said metallic material at the elevated temperature;

said cooling water step comprising contacting the surface of said metallic material with cooling water, wherein the surface of said metallic material has a temperature in a range from 200° C. to 1200° C. at time of initial contact with said cooling water; wherein said cooling water has a pH of −2 to 4.

9. A process for removing scales and preventing scale formation on a metallic material comprising:

providing a metallic material at an elevated temperature, said metallic material having a surface;

providing a cooling water step for said metallic material at the elevated temperature;

said cooling water step comprising contacting the surface of said metallic material with cooling water, wherein the surface of said metallic material has a temperature in a range from 200° C. to 1200° C. at time of initial contact with said cooling water; wherein said cooling water has a pH of −2 to 4;

applying a direct current or alternating current to said metallic material through said cooling water during said cooling step at a current density of 0.1 to $10^5$ A/$m^2$ of unit surface area of said metallic material.

10. A process for removing scales and preventing scale formation on a metallic material according to claim 3 or 9, characterized by using the metallic material as one of a positive electrode or a negative electrode or providing the metallic material between a positive electrode and a negative electrode for the current application.

11. A process for removing scales and preventing scale formation on a metallic material according to claim 3 or 9, characterized by providing at least two of pairs each consisting of a positive electrode and a negative electrode facing each other discretely in a water cooling tank filled with cooling water so that the positive electrodes and the negative electrodes can be alternately arranged in a parallel with one another at distances, passing the metallic material through between the positive electrodes and the negative electrodes in the pairs in the cooling water, thereby contacting the cooling water with the metallic material, and applying a direct current to the metallic material by passing the current between the positive electrodes and the negative electrodes in the pairs.

12. A process for removing scales and preventing scale formation on a metallic material according to claim 3 or 9, characterized in that the cooling water has an electric conductivity of 0.01 to 100 S/m.

13. A process for removing scales and preventing scale formation on a metallic material according to claim 3 or 9, characterized in that water deaerated to a dissolved oxygen gas concentration of not more than $4.46\times10^{-5}$ mol/$m^3$ (1 ppm) is used as the cooling water.

14. A process for removing scales and preventing scale formation on a metallic material according to claim 3 or 9, characterized in that high pressure water with the pressure of 0.2942 to 49.03 MPa is made to hit the metallic material during the water cooling.

15. A process for removing scales and preventing scale formation on a metallic material according to claim 3 or 9, characterized in that high pressure water with the pressure of 0.2942 to 49.03 MPa is made to hit the metallic material after the water cooling.

16. A process for removing scales and preventing scale formation on a metallic material according to claim 3 or 9, characterized in that water containing at least one of hydrogen, ammonia, nitrogen, carbon dioxide and inert gas at a total dissolved gas concentration of $4.46\times10^{-5}$ mol/$m^3$ to 2.23 mol/$m^3$ (1 to $5\times10^4$ ppm) is used as the cooling water.

17. A process for removing scales and preventing scale formation on a metallic material according to claim 3 or 9, characterized in that hydrochloric acid, sulfuric acid or nitric acid is added to the cooling water.

18. A process for removing scales and preventing scale formation on a metallic material according to claim 3 or 9, characterized in that an oxidizing agent is added to the cooling water, thereby adjusting the cooling water to an ORP (oxidation-reduction potential) value of 0.5 V in NHE to 2.0 V in NHE, or a reducing agent is added to the cooling water, thereby adjusting the cooling water to an ORP value of −0.5 V in NHE to −1.5 V in NHE.

19. A process for removing scales and preventing scale formation on a metallic material according to claim 3 or 9, characterized in that cooling water adjusted to an ORP (oxidation-reduction potential) value of 0.5 V in NHE to 2.0 V in NHE by an oxidizing agent or cooling water adjusted to an ORP value of −0.5 V in NHE to −1.5 V in NHE by a reducing agent are used alternately for the cooling.

20. A process for removing scales and preventing scale formation on a metallic material according to claim 3 or 9, characterized in that oxidation potential water is partly or wholly used for the cooling water.

21. A process for removing scales and preventing scale formation on a metallic material according to claim 3 or 9, characterized in that the cooling water is adjusted to a temperature of 50° to 100° C.

22. A process for removing scales and preventing scale formation on a metallic material according to claim 3 or 9, characterized in that the cooling water is contacted with the metallic material at a relative speed of the cooling water and the metallic material to each other of 0.1 to 300 m/s.

23. A process for removing scales and preventing scale formation on a metallic material according to claim 3 or 9, characterized in that the cooled metallic material is successively washed with a liquid and/or a gas and then coated with beef tallow, mineral oil or chemical synthesis oil, followed by coiling.

24. A process for removing scales and preventing scale formation on a metallic material according to claim 23, characterized in that the beef tallow, mineral oil or chemical synthesis oil each contains 0.0001 to 1% by weight of boron.

25. A process for removing scales and preventing scale formation on a metallic material characterized in that a pickling solution is adjusted to a temperature of 50° to 100° C., in such a method that the metallic material is subjected to a pickling treatment by the pickling solution after the process according to claim 3 or 9, followed by coiling.

26. A process for removing scales and preventing scale formation on a metallic material characterized in that a pickling solution is contacted with the metallic material at a relative speed of the pickling solution and the metallic material to one another of 0.1 to 300 m/s in such a method that the metallic material is subjected to a pickling treatment by the pickling solution after the process according to claim 3 or 9, followed by coiling.

27. An apparatus for removing scales and preventing scale formation on metallic material, characterized by comprising a cooling apparatus, side guides and at least two pair of electrodes;

the cooling apparatus, provided at a delivery side of a hot rolling mill, comprising cooling headers and/or cooling nozzles for supplying cooling water;

the side guides, also provided at the delivery side of the hot rolling mill, for preventing leakage of cooling water from side edges of the metallic material;

at least two pair of electrodes, provided in a water cooling tank installed at the deliver side of the hot rolling mill, used for a direct current application to the metallic material, where a positive electrode and a negative electrode are set at an interval facing each other and the positive electrodes and negative electrode are alternately arranged in parallel with one another; and the direct current is applied to the metallic material by the pair of negative and positive electrodes when the metallic material passes through between the pair of positive and negative electrodes.

28. An apparatus for removing scales and preventing scale formation on a metallic material, characterized by comprising a cooling apparatus, side guides, pinch rolls and apron guides;

the cooling apparatus, provided at a delivery side of a hot rolling mill, comprising cooling headers and/or cooling nozzles for supplying cooling water;

the side guides, also provided at the delivery side of the hot rolling mill, for preventing leakage of cooling water from side edges of the metallic material;

the pinch rolls and apron guides, used for a direct current application to the metallic material, provided at the delivery side of the hot rolling mill;

where the pinch rolls are in electric contact with the metallic material and the apron guides are in non-electric contact with the metallic material, and the pinch rolls and apron guides act as electrodes, and electric current is applied to the metallic material by allowing the electric current to flow between the pinch rolls and apron guides through cooling water.

* * * * *